US005486669A

United States Patent [19]

Oshgan

[11] Patent Number: 5,486,669

[45] Date of Patent: Jan. 23, 1996

[54] DETENTED PADDLE BLADE SWITCH ASSEMBLY

[75] Inventor: Thomas J. Oshgan, Mt. Prospect, Ill.

[73] Assignee: Eaton Corporation, Cleveland, Ohio

[21] Appl. No.: 326,886

[22] Filed: Oct. 21, 1994

Related U.S. Application Data

[63] Continuation of Ser. No. 106,005, Aug. 13, 1993, abandoned.

[51] Int. Cl.[6] ..... H01H 3/20

[52] U.S. Cl. ..... 200/556; 200/553; 200/554; 200/557

[58] Field of Search ..... 200/556, 553, 200/554, 557, 558, 559, 113, 555

[56] References Cited

U.S. PATENT DOCUMENTS

| | | | |
|---|---|---|---|
| 3,562,462 | 2/1971 | Long | 200/153 |
| 3,591,747 | 7/1971 | Dennison | 260/557 |
| 3,679,846 | 7/1972 | Dillon et al. | 200/556 |
| 3,879,592 | 4/1975 | Comerford et al. | 200/557 |
| 4,000,383 | 12/1976 | Lockard | 200/16 D |
| 4,002,874 | 1/1977 | Brown | 200/556 |
| 4,117,280 | 9/1978 | Feaster | 200/6 B |
| 4,160,128 | 7/1979 | Brown | 200/67 A |
| 4,843,200 | 6/1989 | Parlatore et al. | 200/553 |
| 4,924,047 | 5/1990 | Tsuge | 200/553 |
| 4,947,008 | 8/1990 | Sato et al. | 200/6 R |

*Primary Examiner*—William A. Cuchlinski, Jr.
*Assistant Examiner*—David J. Walczak
*Attorney, Agent, or Firm*—Roger A. Johnston

[57] ABSTRACT

A lever type switching assembly having a pair of generally U-shaped spring blade contact members disposed in oppositely spaced-parallel arrangement for alternate actuation by a common paddle lever frictionally contacting the contact members for effecting switching upon user movement of the lever in a clockwise direction. Each contact blade member has one end pivoted on a center contact for rocking motion to cause the U-shaped region and the opposite end of the blade member to make and break contact with side-contacts on opposite sides of the center contact. Overtravel of the paddle in one direction after actuation causes the contact blade member to break from the side contact and make contact with an auxiliary contact. A spring biased plunger on the paddle lever engages a detent surface on the base to give a tactiley discernible indication.

9 Claims, 4 Drawing Sheets

DETENTED PADDLE BLADE SWITCH ASSEMBLY

This application is a continuation of application Ser. No. 08/106,005, filed Aug. 13, 1993, now abandoned.

BACKGROUND OF THE INVENTION

The present invention relates to lever-actuated electrical switches, and particularly switches actuated by a pivoted paddle member which frictionally engages a rockable resilient spring blade member to alternately connect a common electrical contact with contacts disposed on opposite sides of the common contact.

Switches of the aforesaid type find particular use in automotive accessory applications as, for example, control switches employed for operating automotive door window lift motors in opposite directions, and for automotive door lock solenoid operations and other user convenience accessories. It has been found desirable in such applications to provide a tactile feel when departing from the "OFF" or "NEUTRAL" position of automotive user convenience accessory switches, particularly where multiple functions or positions are provided for a single accessory switch. In particular, it has been desired to provide a tactile feel for a switch of the aforesaid type for automotive window lift motor and door lock controls, and to provide an additional switching function of the switch in one direction of actuation to enable an "EXPRESS DOWN" function for the window lift motor. This type of additional function, such as for the window lift motor, permits the user to move the switch actuator or paddle to an overtravel or further movement of the actuator in the direction after initial actuation to provide the secondary function. In automotive window lift motor control applications, the secondary function is "EXPRESS DOWN" wherein an electronic circuit is enabled for latching the motor into a mode of continuous operation such that the user can release pressure on the switch paddle, allowing the paddle to return to a neutral position, and the window lift motor will continue to operate until the window is lowered to its limit position.

It has thus been desired to provide a simple, reliable means for providing an action to a paddle-type switch that allows for a detent feel in a manner which is low in manufacturing cost and easy to assemble in high-volume mass production, particularly for use in automotive accessory switching applications.

SUMMARY OF THE INVENTION

The present invention provides a paddle-type actuated switch particularly suited for remotely controlled reversible operation of motors and employs a pair of pivoted or rockable switch blade springs alternately actuated by movement of the actuator paddle in opposite directions for providing reversible motor operation. The common actuator plunger provided on the paddle engages in a recess provided in the switch housing intermediate of the contact blades and a separate bow spring acts against the actuator to return the actuator to the neutral position. The switch of the present invention provides a tactile feel which is discernible to the user. The switch of the present invention is particularly suitable for remote control of automotive window lift motors and door lock solenoids.

DETAILED DESCRIPTION

Figure 1:
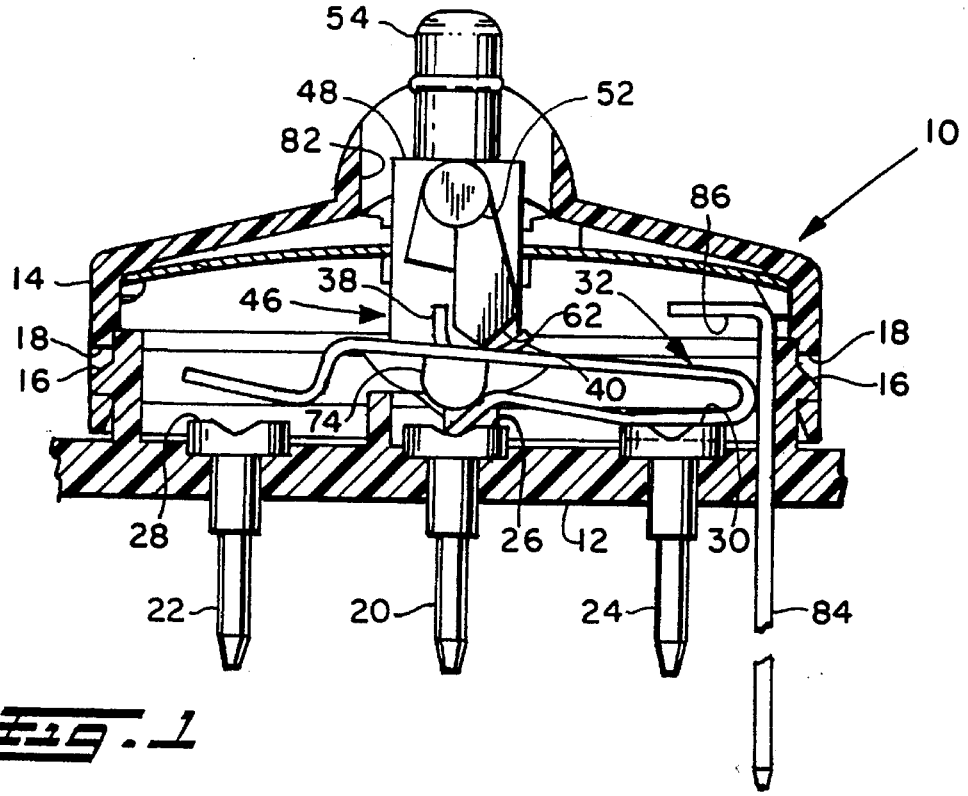
FIG. 1 is a side elevation view of the switch of the present invention with the cover and base broken away.

Referring to FIGS. 1, 2, 3, 4, 5, and 6, the switch assembly is indicated generally at 10, and has a housing deck or base 12 which has a housing cover or shell 14 secured thereover by any releasable expedient as, for example, snap-locking over tabs 16 provided on the sides of the deck 12 which engage cut-outs 18 provided in the cover.

A plurality of electrical connecting terminals are provided in the base 12, and preferably arranged in two spaced rows, one row of which is illustrated in the drawings and comprises three spaced terminals indicated by reference numerals 20 for the center terminal which is a electrically a common terminal, and side terminals 22,24. Each of the terminals 20,22,24 has an enlarged head portion on the interior of the base 12, and which extends outwardly thereof along the inner surface of the base 12, as denoted, respectively, by reference numerals 26,28,30 in FIG. 1.

Figure 6:
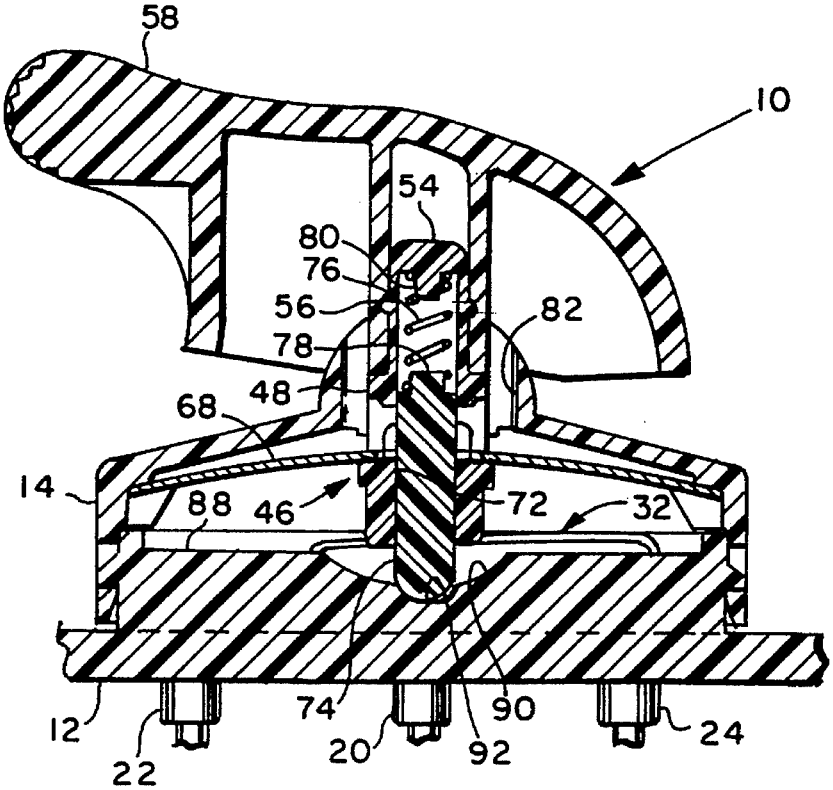
FIG. 6 is a section view, taken along the plane of symmetry of the present invention showing the actuator spring and plunger construction.
Figure 7:
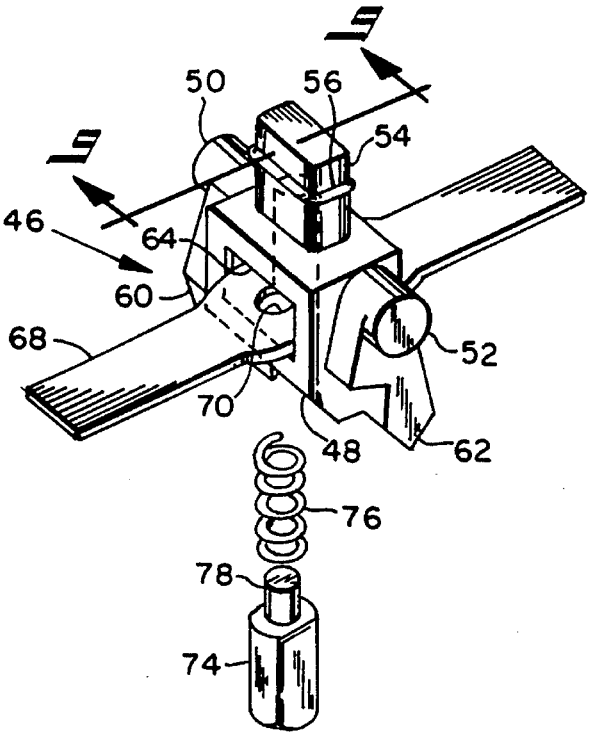
FIG. 7 is an axonometric view of the actuator assembly of the present invention.
Figure 8:
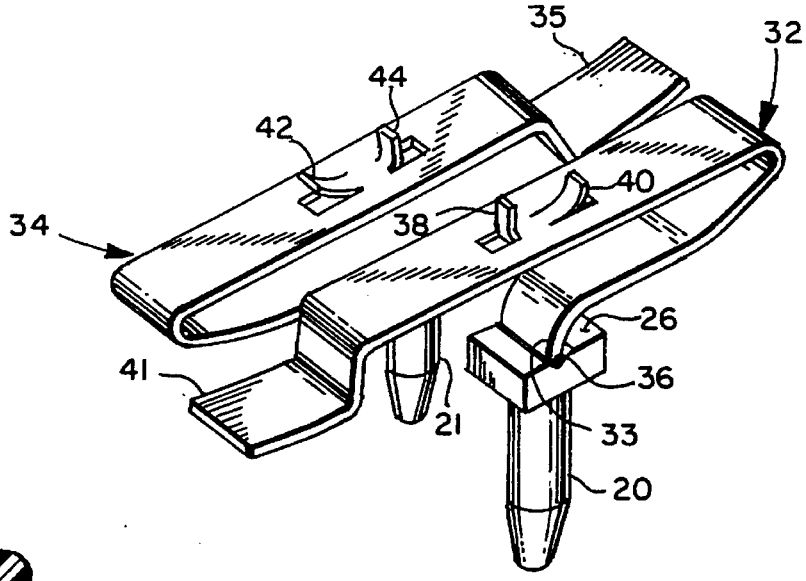
FIG. 8 is an axonometric view of the pivoted contact blade spring members; and, FIG. 9 is a section view, taken along section-indicating lines 9—9 of FIG. 7, showing the return spring and actuator.

Referring to FIGS. 1, 2, 6, 7, 8, and 9, a pair of generally U-shaped rocker-type contact blade members, indicated generally at 32,34 in FIG. 8. The contact blade members 32,34 each have one end 33 thereof bent downwardly and pivoted in a groove provided in the adjacent center contact, as denoted on contact 26 by reference numeral 36 in FIG. 8. Contact spring blade member 34 has an end similar to the end 33 of blade member 32, which is disposed in a corresponding groove (not shown) in contact terminal 21, a portion of which is visible in FIG. 8. Contact blade members 32,34 are disposed with the folded or U-shaped portions thereof are disposed in oppositely located arrangement. Each of the contact blade members 32,34 has a pair of upturned spaced tabs provided thereon directly above the common contact terminals 20,21 as denoted, respectively, by reference numerals 38,40 and 42,44 in FIGS. 2 and 8.

Figure 9:
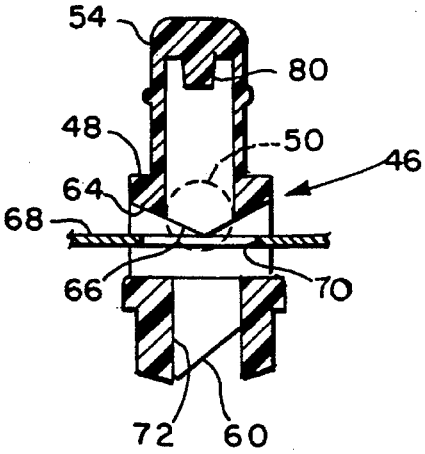

Referring to FIGS. 6, 7, and 9, a switch actuator subassembly indicated generally at 46, and which includes a pivoted block 48 with oppositely extending aligned trunions 50,52 extending therefrom; and, it will be understood, which are journalled for pivotal movement in corresponding sockets (not shown) provided in the cover 14 on opposite sides thereof. Actuator block 48 has a lug or tower 54 extending upwardly therefrom, and which has a circumferential rib 56 provided therearound for frictionally engaging a suitable user knob or button, such as knob 58, as shown in FIG. 6.

Referring to FIGS. 1, 7, and 9, block 48 of actuator 46 has a generally wedge-shaped actuating surface provided below each of the trunions 50,52, as denoted, respectively, by reference numerals 60, 62 for actuation of the individual switch blade members 32,34.

Referring to FIGS. 1, 7, and 8, wedge-shaped surface 62 on block 48, is disposed intermediate the tabs 38,40 on contact blade member 32; and, wedge shaped surface 60 is disposed between tabs 42,44 on contact blade 34. Block 48 has a generally rectangular aperture 64 provided therethrough, and which has received therethrough a centering blade spring 68 having a central aperture 70 provided in the spring aligned with a vertically-extending rectangular cross-section of bore 72 provided in the block 48. Spring 68 is registered against pivot surface 66 formed in the center of rectangular aperture 64.

A rectangular shaped plunger 74 is slidably received in the bore 72 and through aperture 70 and blade spring 68 and is biased in the downward direction by spring 76, which has the lower end registered against the upper end of plunger 74 over guide lug 78 and has the upper end registered over a lug 80 provided at the upper end of bore 72 in block tower 54.

The upper portions of block 48 and tower 54 extend outwardly of the cover 14 through an aperture 82 provided therein.

Referring to FIG. 1, an auxiliary electrical connector terminal 84 is disposed spaced adjacent terminal 24. The terminal 84 has the upper end thereof formed in a generally right angle configuration to provide an auxiliary contact terminal 86, and which is disposed in line with contact surface 30 and spaced thereabove.

Referring to FIG. 6, actuator assembly 46 is shown assembled into the cover with the blade spring 68 having its ends secured in the cover. Spring 68 is bowed and provides a downward biasing force against the block 48.

Figure 2:
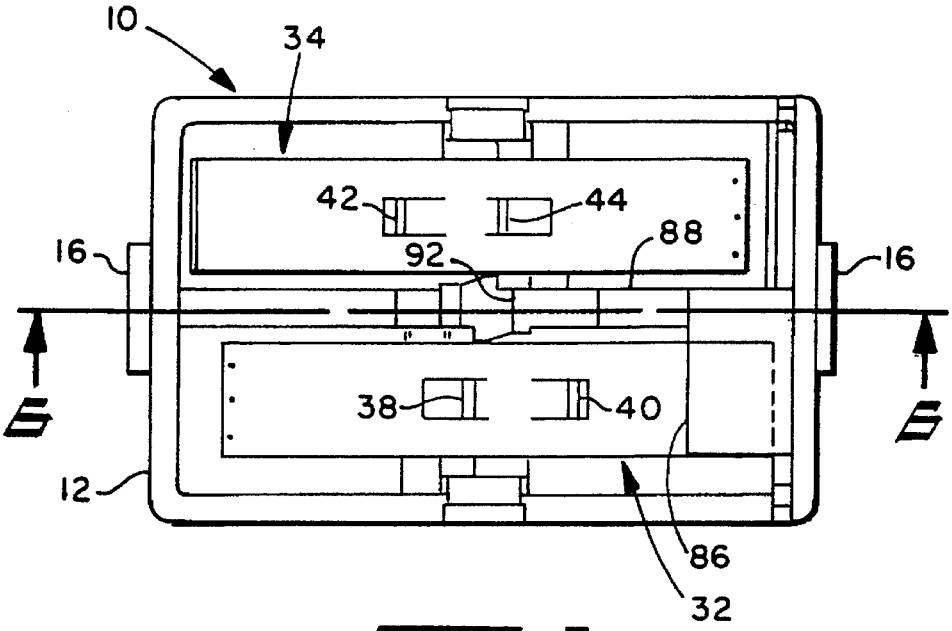
FIG. 2 is a top view of the switch, with the case cover and actuator removed and showing the side-by-side disposition of the contact blades.

Referring to FIG. 2, a rib 88 is provided in the base 12 between the contact blades 32,34; and, the rib 88 extends the length of the base in the presently preferred practice. Rib 88 has formed in the central region thereof a generally concave downward configuration which forms camming surface 90, which has a detent recess 92 formed in the center thereof. When actuator 46 is in the neutral position shown in FIG. 6, the lower end of plunger 74 is biased by spring 76 downwardly into recess 92 to provide the detent for the neutral position. With reference to FIG. 1, it will be understood that when actuator 46 is in the neutral position, the U-shaped end of blade contact spring 32 is biased by the wedge shaped surface 62 in a clockwise direction to make contact with contact surface 30 on the stationary terminal. It will also be understood that in this clockwise position, the contact 28 is open with respect to the contact blade member 32.

It will be understood that when actuator 46 is in the neutral position shown in FIG. 1 and 6, contact blade member 34 is pivoted in a counter- or anti-clockwise direction such that the U-shaped portion thereof is closed against the contact (not shown) directly below the U-shaped portion.

Figure 3:
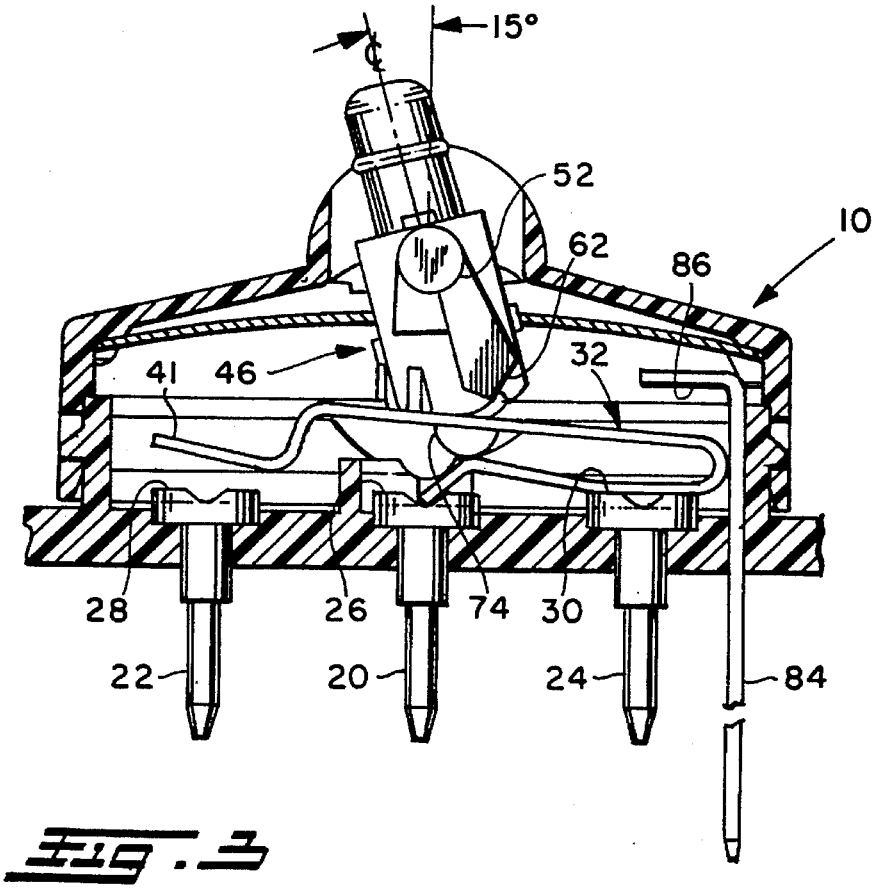
FIG. 3 is a view similar to FIG. 1, showing the actuator rotated in an anti-clockwise direction to an actuated position with the blade contact not shown.

Referring to FIGS. 3, 7, and 8, when the actuator 46 is rotated in the anti-clockwise direction to a position of 15 degrees as shown in FIG. 3, wedge surface 60 acts against tab 44 and rotates contact blade anti-clockwise to close the right hand or free end 35 (not shown) thereof downwardly to close against a contact (not shown) located directly therebelow and behind contact 30. Simultaneously, wedge surface 62 of actuator 46 acts against tab 40 on contact blade 32, thereby increasing the contact force of the U-shaped portion of contact blade 32 against contact 30.

Figure 4:
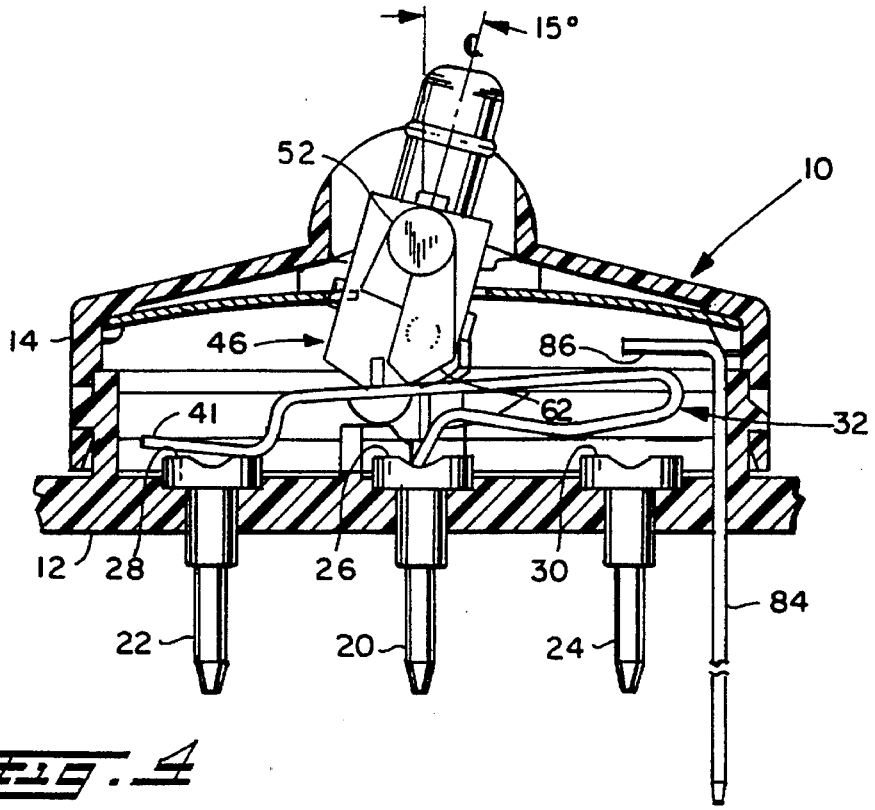
FIG. 4 is a view similar to FIG. 1, and shows the actuator rotated in the clockwise direction to an actuated position.

Referring to FIGS. 4, 7, and 8, rotation of the actuator 46 to a position of 15 degrees in a clockwise direction from the neutral position, as shown in FIG. 4, causes wedge surface 60 to act against tab 42 of contact blade member 34 and rotates contact blade 34 in an anti-clockwise direction and effects lifting of end 35 thereof to an open circuit or free position, and closes the U-shaped end of blade member 34 downwardly against a stationary contact (not shown) which is located directly therebelow and behind contact 28. Simultaneously, wedge surface 62 contacts tab 38 and causes contact blade member 32 to be rotated in an anti-clockwise direction to the position shown in FIG. 4 moving end 41 thereof downwardly to close against contact 28; and, U-shaped portion thereof is lifted from behind contact 30.

Figure 5:
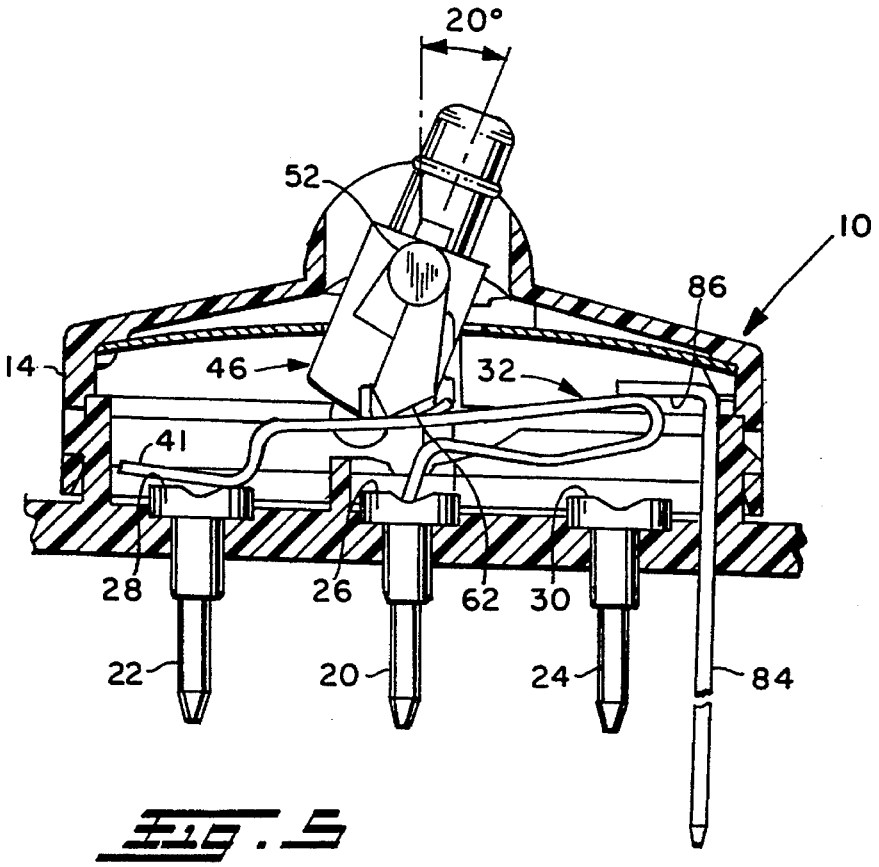
FIG. 5 is a view of the actuator of FIG. 4, rotated an additional five degrees in the clockwise direction for effecting a secondary switching function.

Upon further rotation of actuator 46 in a clockwise direction, from the position shown in FIG. 4 to the position shown in FIG. 5, wedge surface 62 acts further against tab 38 of contact member 32 increasing the contact force of the end portion to close against auxiliary contact 86, thereby effecting a separate circuit function. In an automotive window lift motor application, contact 86 sends a signal through connector 84 to a separate control circuit (not shown) for effecting an "EXPRESS DOWN" window lower function.

The present invention thus utilizes the inherent resiliency of the folded back on itself or U-shaped end of the contact blade member to absorb overtravel movement of a pivoted actuator to effect auxiliary switching functions.

Although the invention has been described with respect to the illustrated embodiments, it will be understood that the invention is limited only by the following claims.

We claim:

1. An electric switching assembly comprising:

(a) housing means;

(b) a contact blade member, said blade member comprising a unitary strip of electrically conductive spring material having an end formed in a generally U-shaped configuration, said strip terminating intermediate said U-shape and an opposite end of said strip;

(c) first and second stationary electrical side contacts mounted on said housing means and a common electrical contact spaced intermediate said first and second side contacts with the said U-shaped end of said blade member pivoted on said common terminal;

(d) actuating means pivotally mounted for user movement between a neutral position and a clockwise and anti-clockwise actuated positions on said housing means, said actuating means having portions thereof frictionally contacting said blade member intermediate said U-shape and said opposite end, wherein upon user movement of said actuating means to one of said actuated positions said blade member is resiliently deflected and moved between one of a clockwise and anti-clockwise position having said U-shaped portion contacting one of said first and second contacts with the said end opposite said U-shaped portion contacting the other of said first and second contacts in the other of said clockwise and anti-clockwise positions;

(e) spring means biasing said actuating means to the neutral position;

(f) means moveable on said actuating means including biasing means biasing said means in one direction; and, (g) said housing means defining detent surfaces located adjacent said contact blade member, wherein said moveable means is operable to directly contact said detent surfaces, and provide detenting of said actuating means between said clockwise and anti-clockwise positions.

2. The switching assembly defined in claim 1, wherein said detent surfaces are disposed to provide detenting of said actuating means in said neutral position.

3. The switch assembly defined in claim 1, further comprising a third contact spaced from one of said first and second contacts at a common station therewith such that deliberate user over-travel of said actuating means in said one of said positions causes said U-shaped configuration of said blade member to close against said third contact.

4. An electrical switching assembly comprising:

(a) housing means;

(b) a common electrical contact mounted on housing means;

(c) a contact blade member having a portion thereof arcuately formed back on itself into a spring and a first of said folded portion disposed intermediate said folded portion and another end, said first end pivoted on said common contact;

(d) first and second switching contacts mounted on said housing means and disposed on opposite sides of said common contact and upon pivotal movement of said blade member to one of a clockwise and anti-clockwise position, contact is made between said arcuately formed portion and one of said first and second contacts, and upon pivotal movement of said blade member into another of said positions, said contact is broken and the end of said blade opposite said folded end makes contact with the other of said contacts;

(e) actuating means pivoted on said housing means and user moveable in opposite directions from a neutral position to first and second actuated position and operative to move said blade member to said clockwise and anti-clockwise positions;

(f) means biasing said actuating means to the neutral position;

(g) moveable means including spring biased means on said actuating means; and, (h) said housing means defining detent surfaces located adjacent said contact blade member, wherein said moveable means is operable to directly contact said detent surfaces and provide detenting of said actuating means between said clockwise and anti-clockwise positions.

5. The assembly defined in claim 4, wherein said detent surfaces are disposed to detent said actuating means in said neutral position.

6. The assembly defined in claim 4, wherein a third side contact is disposed spaced from said one of said first and second switching contacts at a common station therewith such that upon user movement of said actuating means to an overtravel position from one of said first and second positions said folded portion of said blade member breaks contact with said one of said switching contacts and closes against said third side contact.

7. An electric switching assembly comprising:

(a) housing means;

(b) a pair of contact blade members disposed in spaced relationship each comprising a unitary strip of electrically conductive spring material having a certain portion thereof having one end folded back on itself and formed in a generally U-shaped configuration with an end termination thereof intermediate said folded portion and an opposite end of said strip;

(c) a common electrical contact mounted on said housing means and spaced intermediate first and second spaced side contacts with said end termination of each of said blade members pivoted on said common terminal;

(d) actuating means pivotally mounted for user movement on said housing means from a neutral position to a first and second actuated position on opposite sides of neutral, said actuating means having portions thereof frictionally contacting each blade member, wherein, upon user movement of said actuating means, to said first actuated position said folded portion of each of said blade members is resiliently deflected and moved between one of a clockwise and anti-clockwise position having said folded portion contacting one of said first and second contacts and upon user movement to said second actuated position said blade member is moved to the other of said clockwise and anti-clockwise position and said opposite end of said strip closes against the other of said first and second contacts;

(e) moveable means, including biasing means on said actuating means disposed intermediate said pair of blade members; and, (f) said housing means defining detent surfaces located intermediate said blade members, wherein said moveable means is operable to contact said detent surfaces and provide detenting of said user movement of said actuating means.

8. The assembly defined in claim 7, wherein said moveable means comprises a plunger member slidably mounted on said actuating means; and said bias means includes a spring;

9. The assembly defined in claim 7, wherein said detent surfaces comprise an arcuately shaped track and is operative to detent said actuating means to said neutral position.

* * * * *